US009862193B2

(12) United States Patent
Folkins et al.

(10) Patent No.: US 9,862,193 B2
(45) Date of Patent: Jan. 9, 2018

(54) SYSTEM AND METHOD TO MAINTAIN PRINTHEADS OPERATIONAL IN A CONTINUOUSLY PRINTING SYSTEM

(71) Applicant: Xerox Corporation, Norwalk, CT (US)

(72) Inventors: Jeffrey J. Folkins, Rochester, NY (US); James R. Larson, Fairport, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 34 days.

(21) Appl. No.: 14/824,221

(22) Filed: Aug. 12, 2015

(65) Prior Publication Data

US 2017/0043585 A1 Feb. 16, 2017

(51) Int. Cl.

| | |
|---|---|
| ***B41J 2/165*** | (2006.01) |
| ***B41J 2/515*** | (2006.01) |
| ***B41J 25/304*** | (2006.01) |

(52) U.S. Cl.

CPC ..... *B41J 2/16517* (2013.01); *B41J 2/16588* (2013.01); *B41J 2/515* (2013.01); *B41J 25/304* (2013.01); *B41J 2002/1657* (2013.01)

(58) Field of Classification Search

CPC ..... B41J 2/165; B41J 2/205

See application file for complete search history.

(56) References Cited

U.S. PATENT DOCUMENTS

| | | | | |
|---|---|---|---|---|
| 5,587,730 | A | 12/1996 | Karz | |
| 5,963,770 | A | 10/1999 | Eakin | |
| 6,203,135 | B1 | 3/2001 | Murcia et al. | |
| 6,481,822 | B2 | 11/2002 | Murcia et al. | |
| 6,644,775 | B2 | 11/2003 | Murcia et al. | |
| 6,789,873 | B2 | 9/2004 | Booth | |
| 6,896,349 | B2 | 5/2005 | Valero et al. | |
| 7,207,668 | B2 | 4/2007 | Jones et al. | |
| 7,448,719 | B1 | 11/2008 | Newell | |
| 7,901,029 | B2 | 3/2011 | Baker | |
| 8,172,359 | B2 | 5/2012 | Askeland et al. | |
| 8,231,198 | B1 | 7/2012 | Askeland et al. | |
| 2003/0081053 | A1* | 5/2003 | Barinaga | B41J 2/16547 347/32 |
| 2006/0139396 | A1 | 6/2006 | Baker | |
| 2006/0275532 | A1 | 12/2006 | Dechert | |
| 2008/0218574 | A1* | 9/2008 | Furuno | B41J 2/2146 347/100 |
| 2009/0091596 | A1* | 4/2009 | Askeland | B41J 2/16588 347/22 |

* cited by examiner

*Primary Examiner* — Kristal Feggins
*Assistant Examiner* — Kendrick Liu
(74) *Attorney, Agent, or Firm* — Maginot Moore & Beck LLP

(57) ABSTRACT

A printer is configured to continue printing during maintenance of at least one printhead in the printer. The printer includes a plurality of printheads that each eject drops that overlap with adjacent drops ejected by another printhead. At least one printhead is selected for maintenance, moved to a position for performance of a maintenance operation, and returned to the position from which it was originally moved, while the remaining printheads continue to eject drops. The newly serviced printhead is returned to the position from which it was originally moved.

9 Claims, 5 Drawing Sheets

SYSTEM AND METHOD TO MAINTAIN PRINTHEADS OPERATIONAL IN A CONTINUOUSLY PRINTING SYSTEM

TECHNICAL FIELD

This disclosure relates generally to printheads in printers, and, in particular, to the maintenance of printheads in printers.

BACKGROUND

Imaging devices such as inkjet printers typically operate one or more printheads that are configured to eject ink for marking media. In direct marking printers, the ink is applied directly to the media, rather than to an intermediate printing surface. The media can be, for example, a surface of a continuous web of media material, a series of media sheets, or other surfaces that are desirably marked. A printhead controller typically controls the one or more printheads by generating a firing signal with reference to image data.

High speed printing systems are typically configured as continuous web printers in which a supply of media is provided in a large roll that is unwound by one or more actuators that pull media from the roll and propel it through the printing system. The web passes an arrangement of printheads that eject ink or other materials onto the media as the web passes the printheads to form images on the web. Two or more printheads can be mounted to a support structure to form an array of printheads that extends across the web in a cross-process direction. In these printers, printhead arrays are arranged in the process direction, which is the direction in which the web moves past the printhead arrays, and which is perpendicular to the cross-process direction.

These high speed printers are sometimes operated in environments that produce significant amounts of dirt or debris. The debris can be particularly significant in manufacturing environments in which the print media is a fibrous mat that is printed with adhesives or other materials. The fibers released from the web into the air can come to rest on the faces of the printheads where they can mix with ink or other materials being ejected by the printheads and remain. Some of these fibers can block nozzles in the faceplate of the printheads and adversely impact the operational status of the ejectors in the printheads. In previously known printers, the printing process would be stopped and the printheads cleaned to remove the fibers from the printheads. Such workflow stoppage is not well tolerated in manufacturing environments where the printing process can be expected to be operating 99% of the time during an eight hour run.

What is needed is a way of operating the printer so the printhead faces can be cleaned from time to time without adversely impacting the productivity of the printer.

SUMMARY

To reduce damage and contamination of printheads in a printer while minimizing interruption to the printing process or impacting the quality of the printing, a printer has been configured with an array of printheads that enables the arrays to be interchanged so printhead maintenance can occur without interrupting the printing performed by the printer. The printer includes a plurality of printheads that are configured to enable drops of material ejected by each of the printheads in the plurality of printheads onto a surface to overlap adjacent drops ejected by another printhead in the plurality of printheads, at least one actuator operatively connected to the printheads in the plurality of printheads, and a controller operatively connected to the plurality of printheads and to the at least one actuator. The controller is configured to (1) operate the printheads in the plurality of printheads to eject drops of material onto the surface, (2) identify at least one printhead in the plurality of printheads for maintenance, (3) operate the at least one actuator to move the at least one printhead from a first position that enables the at least one printhead to eject material drops onto the surface to a second position that enables a maintenance operation to be performed on the at least one printhead while the controller continues to operate the printheads in the plurality of printheads, except the at least one printhead, to eject drops of material onto the surface that overlap adjacent drops ejected by another printhead in the plurality of printheads, except the one printhead, and (4) operate the at least one actuator to move the least one printhead from the second position to the first position while the controller continues to operate the printheads in the plurality of printheads, except the at least one printhead, to eject drops of material onto the surface that overlap adjacent drops ejected by another printhead in the plurality of printheads.

A method of operating a printer reduces printhead contamination by interchanging one array of printheads with other arrays of printheads to enable printhead maintenance to occur without interrupting the printing performed by the printer. The method includes operating with a controller a plurality of printheads that are configured to enable drops of material ejected by each of the printheads in the plurality of printheads onto a surface to overlap adjacent drops ejected by another printhead in the plurality of printheads, identifying with the controller at least one printhead in the plurality of printheads for maintenance, operating with the controller at least one actuator to move the at least one printhead from a first position that enables the at least one printhead to eject material drops onto the surface to a second position that enables a maintenance operation to be performed on the at least one printhead while the controller continues to operate the printheads in the plurality of printheads, except the at least one printhead, to eject drops of material onto the surface that overlap adjacent drops ejected by another printhead in the plurality of printheads, except the one printhead, and operating with the controller the at least one actuator to move the at least one printhead from the second position to the first position after the maintenance operation is performed while the controller continues to operate the printheads in the plurality of printheads, except the at least one printhead, to eject drops of material onto the surface.

BRIEF DESCRIPTION OF THE DRAWINGS

The foregoing aspects and other features of the present disclosure are explained in the following description, taken in connection with the accompanying drawings.

DETAILED DESCRIPTION

Figure 1:
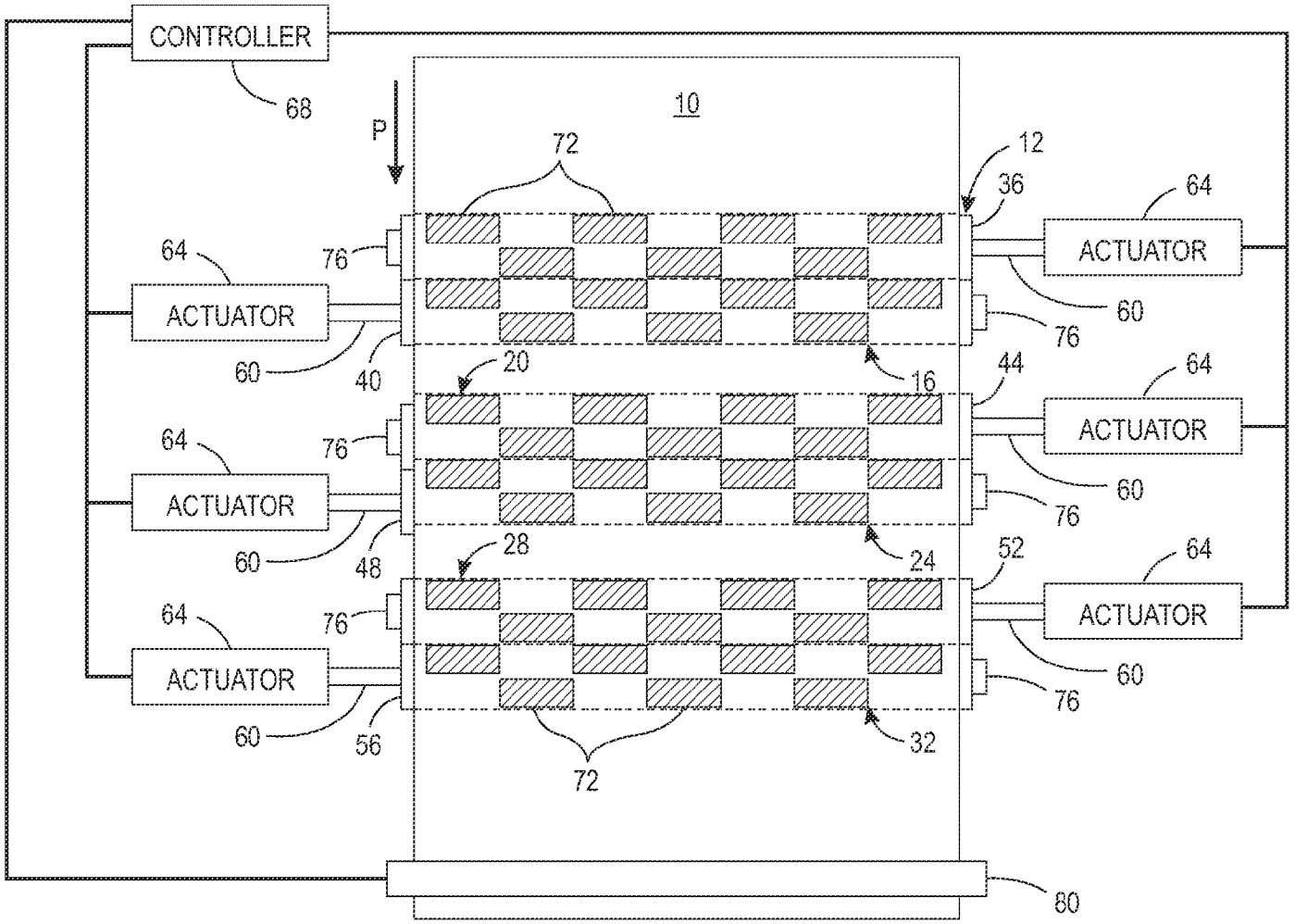
FIG. 1 is a depiction of one embodiment of a print zone in a printer that enables continuous operation and occasional maintenance of the printheads.

For a general understanding of the present embodiments, reference is made to the drawings. In the drawings, like reference numerals have been used throughout to designate like elements.

As used herein, the term "printer" generally refers to a device for applying ink to media to form ink image on media or layering materials to form objects. The printer may include a variety of other components, such as finishers and paper feeders for ink image processing, and planerizers and curing devices for treatment of objects. An image on media or an object corresponds to image data stored in a memory in electronic form. The image data are rendered to generate electrical driving signals that are electrically connected to transducers that eject ink or materials from one or more printheads to form an image on media or an object in the printer. The image data are rendered by a marking engine and such image data may include text, graphics, pictures, object layers and features, and the like. "Media" and "web" can be a physical sheet of paper, plastic, or other suitable physical material that provides a surface for receiving ejected materials.

A "gap" or "gap distance" means a distance between a surface that receives ejected ink or material and a printhead. The term "printhead" refers to a single ink or material ejecting device or to a plurality of such devices arranged in an array of a printhead assembly to cover either a cross-process width of a print surface in a printing device or a length of the print surface in the process direction. An "array," "printhead array," and "printhead assembly" means a plurality of printheads that are mounted to one or more members so they enable printing over a width or length that is larger than a single printhead in the plurality of printheads can cover. A printhead array can include a plurality of printheads that extend linearly in the cross-process width of the media, or can include a plurality of printheads that extend in a staggered fashion that generally extends in the cross-process direction. In some cases, a printhead array extends across less than a full extent of the width of the media such as, for example, a printhead array configured for different sized media such as envelopes or cards. An array can also include printheads configured in a series in the process direction to add either resolution or printing throughput capability.

A "print zone" means a volumetric space defined by a plane of the print surface of the media, a width of the printhead(s) in which the printhead(s) are configured to eject ink, and a height extending between a relatively small distance above a printing face of the printhead(s) and at least the plane of the print surface. In an example, the height extends several millimeters above the nominal distance between the printhead face and the material receiving surface, and can represent a height at which the printhead(s) can eject material onto the surface with at least a predetermined threshold of accuracy.

FIG. 1 is a depiction of a print zone in which six printhead assemblies 12, 16, 20, 24, 28, and 32 are arranged to eject material onto a continuous web 10. Each printhead assembly includes a bar 36, 40, 44, 48, 52, and 56, respectively, to which seven printheads 72 have been mounted in a staggered arrangement. This staggered arrangement enables the ejectors at the left end and right end of the printheads in the lower row of each assembly to be separated from the ejectors at the right end and left end of the adjacent printheads in the upper row by a distance that is same as the distance between adjacent ejectors within each printhead. Thus, the ejectors in the seven printheads can be operated in synchronization with the movement of the web 10 so each ejector can eject a single drop of material onto the web to form a single line at a predetermined resolution, which is measured in dots per inch (dpi).

In the print zone of FIG. 1, each printhead assembly has a fixed position that is defined by stops 76. In one embodiment, the stops 76 are positioned so the printheads in printhead assembly 16 are shifted in the cross-process direction from the printheads in printhead assembly 12 by a distance that is one-fifth of the distance between adjacent nozzles within a printhead 72. In this same embodiment, the printheads in printhead assembly 20 are shifted in the cross-process direction from the printheads in printhead assembly 16 by a distance that is one-fifth of the distance between adjacent nozzles within a printhead 72. Continuing with this embodiment, the printheads in assembly 24 are shifted in the cross-process direction by this same distance from the printheads in assembly 20 and the printheads in assembly 28 are shifted in the cross-process direction by this distance from the printheads in assembly 24. Thus, the printheads in assemblies 12, 16, 20, 24, and 28 of this embodiment are configured to form a line having a resolution that is five times greater than the resolution of a line printed by a single assembly. The sixth printhead assembly 32 in this embodiment is aligned in the process direction with the printheads in the first printhead assembly 12, although it could aligned in the process direction with one of the other printhead assemblies. In one version of this embodiment, a single printhead assembly forms a line having a resolution of 300 dpi so the five printhead assemblies form a line having a resolution of 1500 dpi. At this resolution, the drops are separated by a distance of approximately 16 microns. Since the drops ejected by the printheads in this embodiment are approximately 50 microns in width, adjacent drops overlap resulting in a solid line across the web.

While an embodiment has been described with stops 76 being positioned so the inkjets of each printhead in one array are shifted in the cross-process direction from the inkjets in the printheads of the other arrays, other configurations are envisioned. For example, all of the stops 76 can be positioned so the inkjets of each printhead in the first array in the process direction are aligned in the process direction with the inkjets of a corresponding printhead in each array. Alternatively, the stops 76 can be positioned so some printheads are offset in the cross-process direction from other printheads in other arrays and some printheads are aligned in the process direction with other printheads in other arrays. In other words, the print zone of a printer configured as set forth in this document has N printheads or printhead assemblies and each printhead or printhead assembly has only one fixed position in the print zone. That is, the printhead or printhead assembly is not configured to be positioned at multiple positions within the print zone. Regardless of the configuration, the lines formed by each inkjet ejecting ink or material in a continuous manner as the print surface moves past the printheads are sufficiently close to one another that a solid area of ink or material is formed by all of the inkjets ejecting ink or material for a period of time commensurate with a portion of the print surface passing all of the printheads in the print zone.

In the various configurations described above, the drops ejected by the printhead assembly 32 are sufficiently large that they cover drops ejected by the other printhead assemblies, even the printhead assemblies not aligned in the process direction with assembly 32. Consequently, sufficient coverage of the web is provided when one of the assemblies 12, 16, 20, 24, 28, and 32 is not operating. This ability enables one of the assemblies to be removed from operational status for cleaning or other maintenance and returned to operational status so another assembly can be removed from operational status for cleaning or other maintenance without adverse impact on the image quality of the line formed by the printheads. As used in this document, the term "maintenance" refers to multiple one or more operations performed on a printhead that are intended to improve operation of the printhead. Maintenance operations can include printhead purging, wiping, cleaning, or the like.

Movement of the printhead assemblies is provided by actuators 64, which are connected by reciprocating members 60 to one of the printhead assemblies 12, 16, 20, 24, 28, and 32 as shown in FIG. 1. The actuators 64 are operatively connected to controller 68, which generates signals to operate the actuators selectively to move one assembly to an area outside of the print zone for maintenance, return the assembly to the print zone, and remove another assembly from the print zone. In the embodiment shown in FIG. 1, the actuators 64 translate the printhead assembly connected to the reciprocating member 60 so the movement of the assembly is bidirectional in the cross-process direction. Stop members 76, as noted above, are provided on an opposite side of each printhead assembly 12, 16, 20, 24, 28, and 32 to enable each printhead assembly to return to the position at which the printhead assembly was located when it was removed from service. Again, the printhead assemblies only return to a single position in the print zone because the drops ejected by the five operational printhead assemblies are large enough to overlap the drops ejected by the other printhead assemblies to form a line in the process direction. Thus, the printer described in this document does not require encoders or other positional measuring devices for precise movement of the printhead assemblies. While the embodiment of FIG. 1 shows the actuators being configured to enable three assemblies to be pulled to one side of the print zone and the other three assemblies to be pulled to the other side, other combinations or movement of all of the assemblies to the same side could be configured. The reader should also appreciate that while seven printheads are provided in a single assembly to form a line across the web 10 in the cross-process direction, other numbers of printheads having different widths, including a single printhead, can be configured for this purpose.

The controller 68 is further configured to identify when each printhead assembly is to be moved for maintenance with reference to a predetermined parameter, such as a period of time or length of media passing by the printheads. That is, for each printhead assembly, the controller activates a timer having a predetermined time length or number of events once the printhead assembly is returned to service. Upon expiration of a timer or event counter for a printhead assembly, the controller 68 operates the corresponding actuator 64 to move the printhead assembly out of the print zone for maintenance. In another embodiment, an optical sensor 80 is operatively connected to the controller 68 and the controller is configured to receive signals generated by the sensor 80, analyze the signals to detect an improper ejection of drops, and identify the printhead assembly in which the printhead having the malfunctioning ejectors is located. The optical sensor 80 can be, for example, a linear array of photo detectors and a light source. The light source directs light onto the web after the drops of material ejected by the printheads in the print zone have landed on the web 10. The photo detectors generate signals proportional to the amount of light reflected into the photo detectors. The amount of reflected light is greater in areas having lesser or no material than it is in areas solidly covered by the material. Thus, the controller 68 can detect the absence and position of drops from printheads ejecting the drops onto the web and operate the corresponding actuator to remove the corresponding printhead assembly from the print zone for maintenance. While specific examples of events that result in the performance of a maintenance operation have been described, any event regarding the need for printhead assembly maintenance, which can be measured or statistically predicted, can be used to identify a time for moving an assembly outside of the print zone for the performance of a maintenance operation.

The ejectors in the printheads in the assemblies 12, 16, 20, 24, 28, and 32 are operated by a controller with reference to image data in a known manner. The controller can be the controller 68 or it can be another controller dedicated to operation of the printheads. Thus, the controller 68 can detect an absence of material drops from printheads in one assembly and operate ejectors in a printhead in another assembly that can eject drops close to the location of the missing drops. Alternatively, the controller 68 can transmit signals to the controller operating the printheads with this information so the printhead controller can use image data for operating one printhead in one of the assemblies to operate another printhead in another assembly. Consequently, even when no detection of absent material drops occurs, either because it is an embodiment with no optical sensor or because all of the ejectors are operational, the controller 68 can operate printheads in one assembly with reference to image data for operating printheads in another assembly. Thus, when a printhead assembly is returned to service, the controller 68 can use image data typically utilized for operating printheads in one assembly to operate printheads in that one assembly as well as the printheads in the assembly most recently returned to operational status. In this manner, five of the six printhead assemblies in the first embodiment described above can be used to provide the line having the resolution that is five times greater than the resolution of a single printhead assembly. This feature enables the assembly returning from maintenance to be phased into operation. That is, once the assembly is located at its stop member, image data being used to operate printheads in another assembly can be used to operate some of the ejectors in the newly returned assembly so the load is distributed over two assemblies. This transition can continue so an increasingly larger share of the material ejecting is shifted to the printheads in the newly returned assembly until it is carrying the full load and the other assembly can be moved for maintenance.

While FIG. 1 illustrates a single printhead assembly as being identified for maintenance and moved out of the print zone for that purpose, the reader should understand that the controller 68 can be configured to identify and move multiple printheads simultaneously, in sequence, in groups, or independently as desired. Furthermore, various mechanisms and devices familiar to one of ordinary skill in the art are usable as or with the actuator(s) 64 for moving the printhead assemblies 12, 16, 20, 24, 28, and 32 as described herein. Several exemplary embodiments of such devices are described below, but the reader should understand that other conventional devices and mechanisms are also contemplated.

Figure 2:
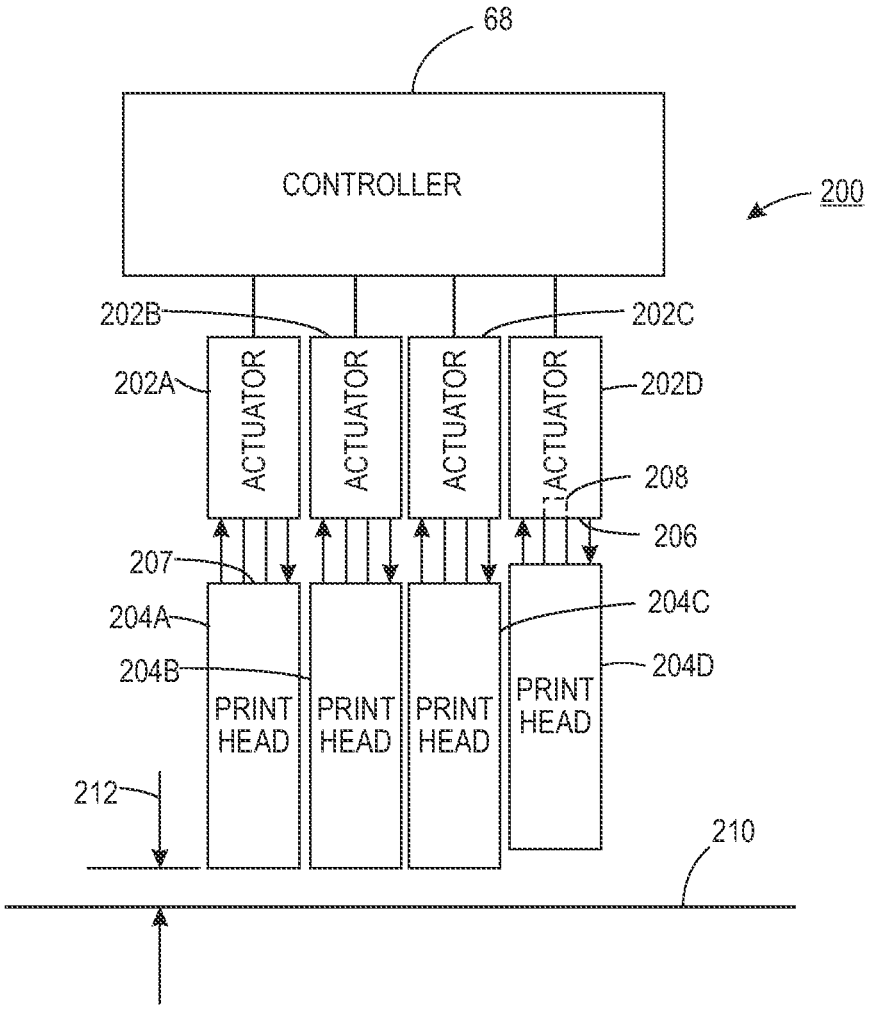
FIG. 2 is a schematic side view of a different embodiment of the print zone shown in FIG. 1.

FIG. 2 illustrates another embodiment in which the printhead assemblies are moved in a direction that is perpendicular to the plane of the web. In this embodiment, a plurality of actuators 202A-D is operatively connected to one of the plurality of printhead assemblies 204A-D, respectively. Since each of the printhead assemblies 204A-D is assigned a respective actuator 202A-D, the printhead assemblies 204A-D can be respectively identified for cleaning and moved independently of each other. Again, printhead assemblies can be a single printhead that extends in the cross-process direction across the web 210. The actuators 202A-D can be linear actuators, and can include, for example, a piston, a camshaft, a pulley or hoist, a gear or gear train, a hydraulic actuator, pneumatic actuator, piezoelectric actuator, a screw drive, a chain drive, a linear motor, or other types of linear translation devices. The actuators 202A-D include a stop surface 206 configured to define a maximum extent of motion that the printhead assemblies 204A-D can be moved away from the web 210. In other words, the stop surface 206 in actuator 202D is configured to engage with the printhead 204D to arrest movement of the printhead assembly 204D when the printhead assembly 204D reaches a distance from the web 210 at which the printhead assembly 204D contacts the stop surface 206. In one embodiment, each assembly in the printhead assemblies 204A-D includes a stop surface 207, which is configured to engage with a corresponding actuator 202A-D or stop surface 206.

As shown in FIG. 2, the actuators 202A-D further include a second stop surface 208 configured to define a maximum extent of the motion of the printhead assemblies 204A-D towards the web 210. In other words, the second stop surface is configured to prevent the printhead assemblies 204A-D from moving closer than the distance 212 from the web 210. The stop surfaces 206, 207, 208 can enable accurate motion of the printhead assemblies 204A-D, which can minimize or eliminate a need to register a location of the printheads 204A-D before operating the printheads 204A-D to eject ink accurately.

Figure 3:
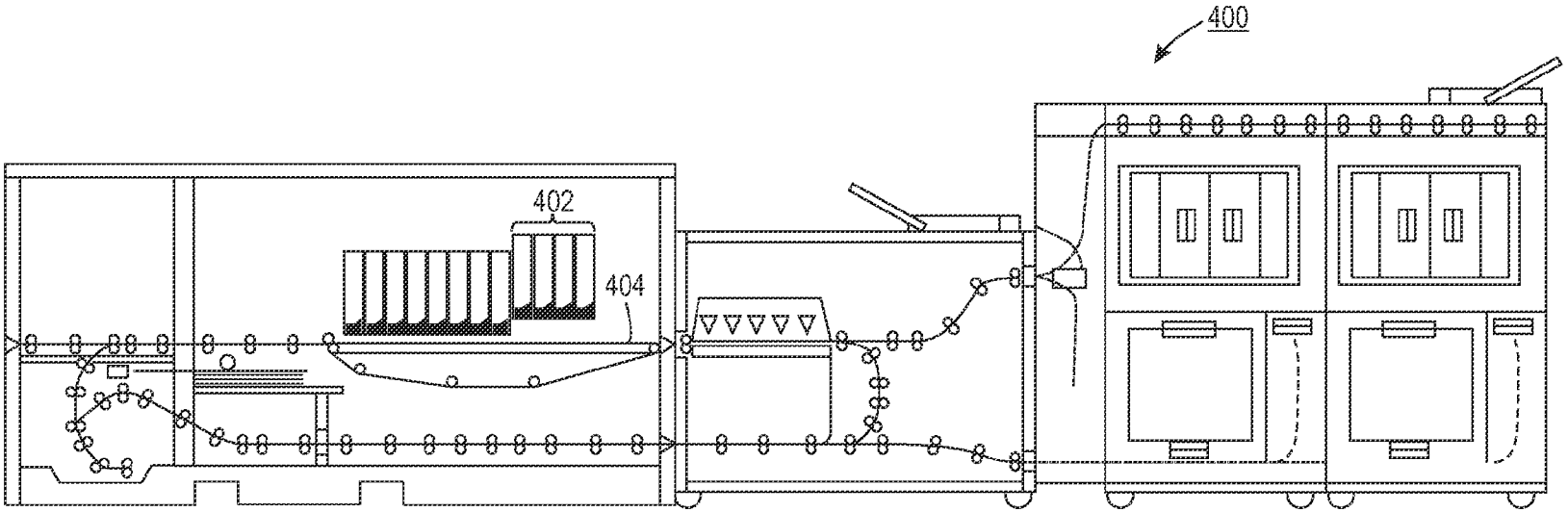
FIG. 3 is a schematic side view of an embodiment of a cut-sheet printer that includes the print zone of FIG. 1 or FIG. 2.
Figure 4:
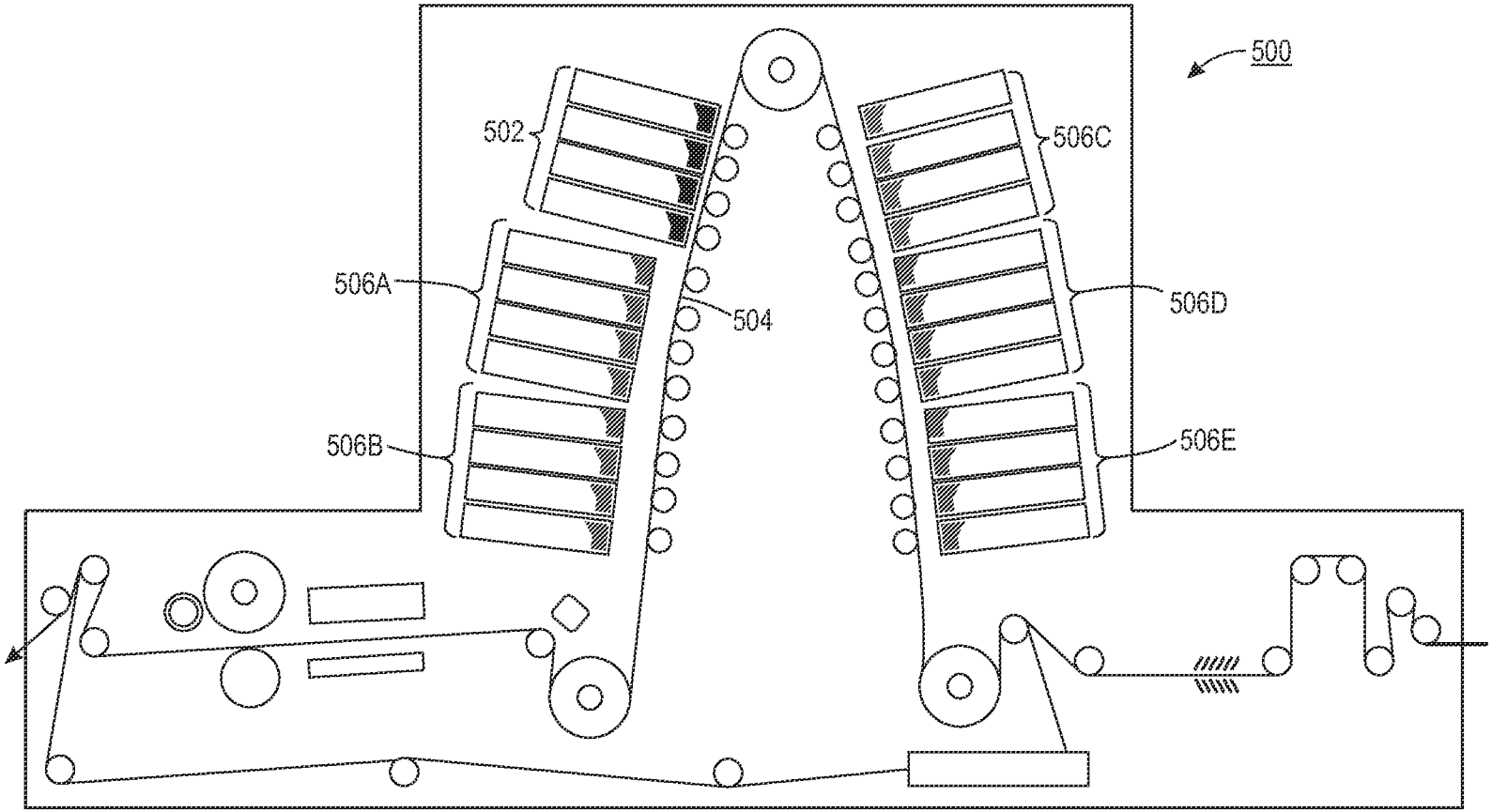
FIG. 4 is a schematic side view of an embodiment of a continuous-feed printing device that includes the print zone of FIG. 1 or FIG. 2.

FIG. 3 illustrates an exemplary cut-sheet media printer 400 where a group of printheads 402 has been moved away from a surface 404 as described above with reference to FIG. 2, and FIG. 4 illustrates an exemplary continuous-feed printer 500 where a group of printheads 502 are positioned to eject material drops on web surface 504 and groups of printheads 506A-E have been moved away from the web surface 504. In FIG. 3 and FIG. 4, the actuator(s) and controller are not shown in order to illustrate other features of the printers 500, 600. As shown in FIG. 3 and FIG. 4, each group of printheads is configured to move in a direction that is normal to the web surface 504, although each group could be configured for translational movement as shown in FIG. 1.

Figure 5:
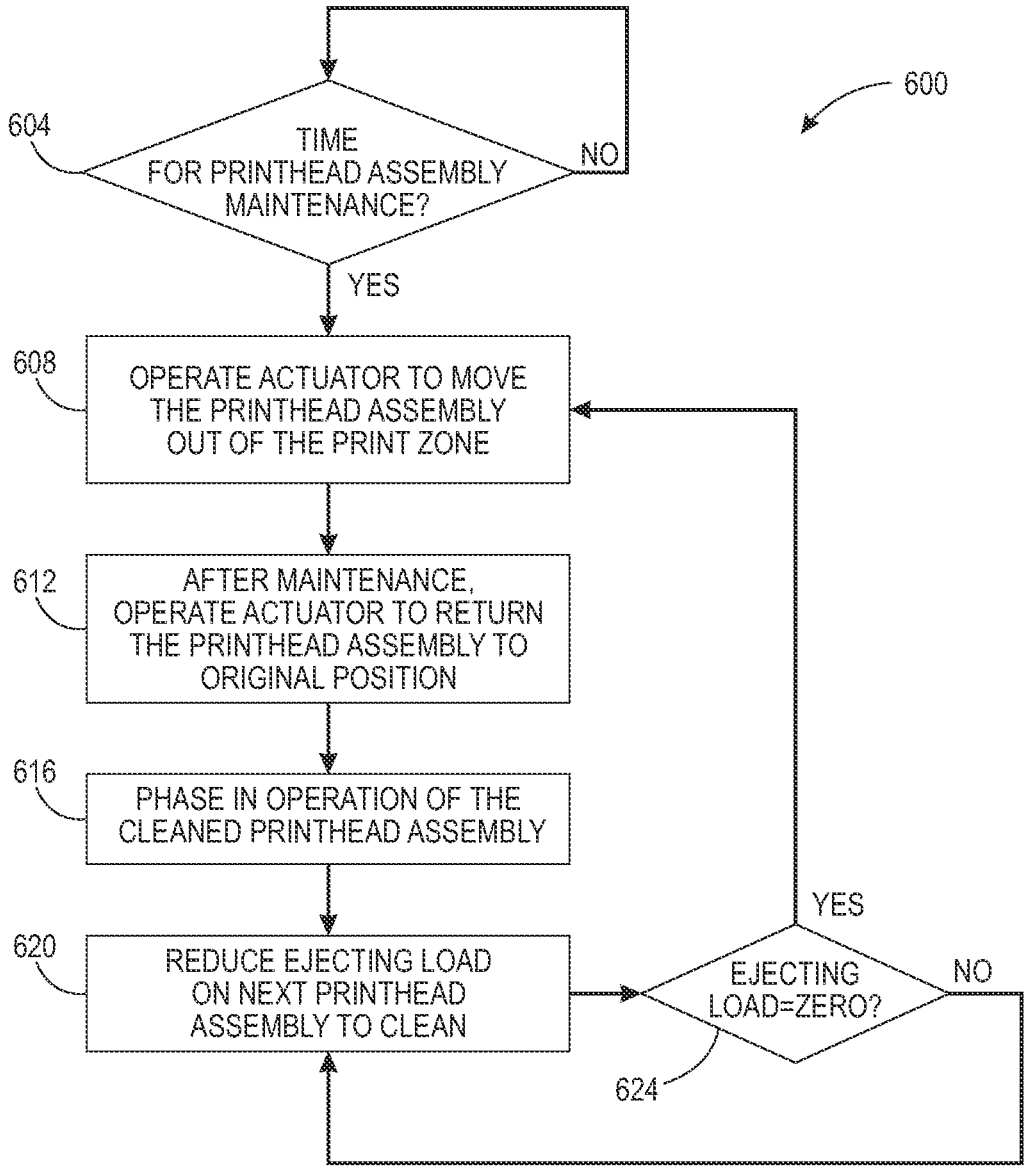
FIG. 5 is a flow diagram illustrating an exemplary process for controlling a printer that enables continuous operation and occasional maintenance of the printheads.

FIG. 5 illustrates an exemplary process 600 for controlling a printer that facilitates continuously printing operation while enabling printhead maintenance during printing operations. The process 600 can be performed, for example, by a controller of the printer as well as other systems or components of the printer or in communication with the printer. The process 600 begins by detecting a time for maintenance to be performed on one of the printhead assemblies in the printer (block 604). An actuator operatively connected to the printhead assembly is operated to move the printhead assembly outside of printhead zone (block 608). After the maintenance operation is performed on the printheads in the printhead assembly, the actuator is operated to return the printhead assembly to the print zone until it encounters its stop member (block 612). As noted above, the movement of the printhead assembly can be reciprocating in the cross-process direction or can be perpendicular to the plane of the web. The process then incorporates the newly serviced printhead assembly into operation (block 616).

This incorporation can be performed in a number of ways. One way of incorporating the newly serviced printhead is to keep it out of the print zone until another printhead assembly is ready to be serviced. Then, the most recently serviced printhead can be returned to the print zone and transitioned into operation as described below. Another way of incorporating the newly serviced printhead is to move it to its position in the print zone but not use the newly serviced assembly for printing until another printhead assembly is ready to be serviced. Then, the most recently serviced printhead can be transitioned into operation as described below. A third way of incorporating the newly serviced printhead assembly into printing operations is performed by moving the assembly back into the print zone and operating the newly serviced printhead assembly with reference to a portion of the image data being used to operate the other five printhead assemblies and reducing the printing performed by the other five printhead assemblies with reference to the portion now being used to operate the newly serviced printhead assembly. In this mode of operation, all six of the printhead assemblies are sharing in the image or object formation. This sharing can be done equally or disproportionally.

With continued reference to FIG. 5, prior to the time for the next printhead assembly to be maintained, the process begins a transition to move the printing being performed by the next printhead assembly to be maintained to one or more printhead assemblies in the printer. This transition reduces the load on the next printhead assembly to be serviced while shifting the amount of the reduced load to one or more printhead assemblies (block 620) and when the next printhead assembly is no longer ejecting material (block 624), the process moves the next assembly out of the print zone for maintenance (block 608). This transition to the movement of the next printhead assembly out of the print zone can include operating the most recently serviced printhead assembly with the image data being used to operate the next printhead assembly to be serviced or by incrementally decreasing the amount of image data used to operate the next printhead assembly to be serviced, while proportionally increasing the image data used to operate the other printhead assemblies with reference to the incremental reduction of the image data used to operate the next printhead assembly to be serviced. In this mode of operation, all six of the printhead assemblies are sharing in the image or object formation. This sharing can be done equally or disproportionally. Alternatively, this transition can be performed by operating one printhead in one of the printhead assemblies with reference to a first portion of the image data to eject drops of material into a first area of the surface, and operating at least one printhead in another printhead assembly with reference to a remainder of the image data to eject drops of material into a second area of the surface, which is exclusive and non-contiguous of the first area.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printer comprising:

a plurality of printheads that are configured to enable drops of material ejected by each of the printheads in the plurality of printheads onto a surface to overlap adjacent drops in a line of drops that extends in a cross-process direction across the surface, each printhead being configured to be positioned at only one position within a print zone formed by the plurality of printheads and the surface;

at least one actuator operatively connected to the printheads in the plurality of printheads; and a controller operatively connected to the plurality of printheads and to the at least one actuator, the controller being configured to:

operate the printheads in the plurality of printheads to eject drops of material onto the surface;

identify at least one printhead in the plurality of printheads for maintenance;

operate the at least one actuator to move the at least one identified printhead from the one position at which the at least one identified printhead is located in the print zone that enables the at least one identified printhead to eject material drops onto the surface to a second position outside the print zone that enables a maintenance operation to be performed on the at least one identified printhead while the controller continues to operate the printheads in the plurality of printheads, except the at least one identified printhead, to eject drops of material onto the surface that overlap adjacent drops to form a line of drops that extends in the cross-process direction; and operate the at least one actuator to move the least one identified printhead from the second position to the one position in the print zone from which the at least one identified printhead was moved while the controller continues to operate the printheads in the plurality of printheads, except the at least one identified printhead, to eject drops of material onto the surface that form the line that extends in the cross-process direction; operate the at least one identified printhead with reference to image data used to operate one other printhead in the plurality of printheads; reduce the image data used to operate the one other printhead incrementally; and increase the image data used to operate the at least one identified printhead with reference to the incremental reduction of the image data used to operate the one other printhead.

2. The printer of claim 1, the controller being further configured to:

operate the at least one actuator to move the at least one identified printhead between the one position for the at least one identified printhead in the print zone and the second position outside of the print zone in a direction that is normal to the surface onto which the drops of material are ejected.

3. The printer of claim 1, the controller being further configured to:

operate the at least one actuator to move the at least one identified printhead between the one position for the at least one identified printhead in the print zone and the second position outside of the print zone in a direction that is parallel to the surface onto which the drops of material are ejected.

4. The printer of claim 1, the controller being further configured to:

detect an absence of material drops for which the at least one printhead was operated to eject; and identify the at least one printhead in response to the detected absence exceeding a predetermined threshold.

5. The printer of claim 1, the controller being further configured to:

detect an expiration of a predetermined time period from a previous maintenance operation being performed on the at least one identified printhead; and identify the at least one printhead in response to the detected expiration of the predetermined time period.

6. The printer of claim 5, the controller being further configured to:

hold the at least one identified printhead at the second position outside of the print zone until another printhead is identified for maintenance.

7. The printer of claim 1, the controller being further configured to:

operate the at least one actuator to move the one other printhead from the one position in the print zone for the one other printhead to a second position outside of the print zone where a maintenance operation can be performed on the one other printhead in response to the image data used to operate the one other printhead being reduced to zero.

8. The printer of claim 1, the controller being further configured to:

operate the one other printhead with reference to a portion of image data to eject drops of material into a first area of the surface; and operate the at least one identified printhead in the plurality of printheads with reference to another portion of the image data to eject drops of material into a second area of the surface, the second area and the first area being exclusive and non-contiguous of one another.

9. The printer of claim 1 further comprising:

a plurality of stops, each stop is positioned to locate the printheads in the plurality of printheads at the only one positions in the print zone for each printhead.

* * * * *